United States Patent [19]

Benedetti et al.

[11] Patent Number: 4,851,194

[45] Date of Patent: Jul. 25, 1989

[54] METHOD AND ARRANGEMENT FOR THE STERILIZATION OF A FILTER

[75] Inventors: Paolo Benedetti; Maurizio Mazzetto, both of Modena; Gianmaurizio Cazzarolli, Curtatona, all of Italy

[73] Assignee: Tetra Dev-Co, Modena, Italy

[21] Appl. No.: 268,643

[22] Filed: Nov. 8, 1988

Related U.S. Application Data

[63] Continuation of Ser. No. 70,266, Jul. 6, 1987, abandoned.

[30] Foreign Application Priority Data

Aug. 25, 1986 [IT] Italy ..... 21520 A/86

[51] Int. Cl.[4] ..... A61L 2/00

[52] U.S. Cl. ..... 422/28; 422/292; 422/302; 53/167

[58] Field of Search ..... 422/28, 292, 302, 304; 210/7-91; 53/167

[56] References Cited

U.S. PATENT DOCUMENTS 3,893,832 7/1975 Perry et al. ..... 422/28

4,326,957 4/1982 Rosenberg ..... 210/436

*Primary Examiner*—Barry S. Richman

*Assistant Examiner*—Lyle Alfandary Alexander

*Attorney, Agent, or Firm*—Burns, Doane, Swecker & Mathis

[57] ABSTRACT

Filters for the supply of inert gas to packing machines are sterilized by passing steam and sterile air through the filters via a number of ducts, valves and governors. A simple method for achieving the sterilization is obtained by sterilizing the filter jointly with the antiseptic packing machine which may be done by connecting one side of the filter in series to the circulation system of the machine for sterilization by a chemical sterilizing agent. In this way the abovementioned arrangement is simplified considerably in that a large number of valves and ducts becomes superfluous.

11 Claims, 1 Drawing Sheet

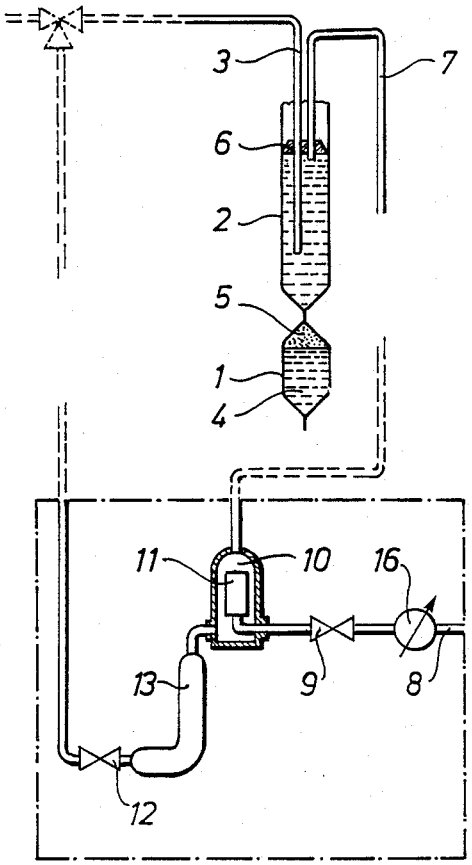
Fig.1
Fig.2
Fig.3
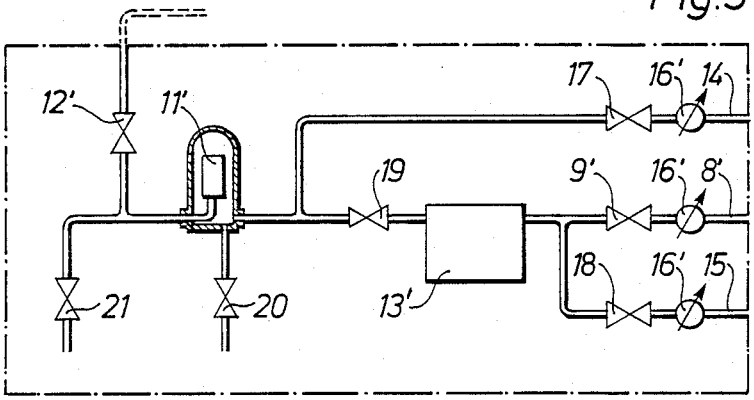

METHOD AND ARRANGEMENT FOR THE STERILIZATION OF A FILTER

This application is a continuation of application Ser. No. 070,260, filed July 6, 1987 now abandoned.

FIELD OF THE INVENTION

The present invention relates to a method for sterilizing a filter in a gas supply duct to a packing machine. The invention also relates to an arrangement for the sterilization of a filter in a duct for the supply of gas to a packing machine comprising a system for the circulation of chemical sterilizing agents.

BACKGROUND OF THE INVENTION

Packing containers of the non-returnable type are used at present for a great number of foodstuff products, e.g. milk, juice, soups, fruit creams and the like. The packing containers, which may be aseptic and filled with goods previously heat-treated or sterilized in some other manner, are manufactured in packing machines,in that prefabricated, laminated plastic and paper material is converted and sealed to liquid-tight packing containers filled with the particular product. In those cases where the packing containers are not wholly filled with the particular contents a certain free volume or heat space, will be present in each packing container which for the sake of the keeping quality is usually filled with an inert gas, e.g. nitrogen gas. A known machine of this type is presented in Swedish patent application no. 82054941 which also describes the method of manufacture of the packing containers. Packing machines of this type are generally also equipped with a cleaning and sterilizing system by means of which the parts coming into contact with the contents can be cleaned and sterilized. The sterilization generally takes place in that a chemical sterilizing agent, e.g. hydrogen peroxide gas, is mixed with air. This circulates within the machine. On the surfaces, which are of a temperature lower than the dew point of the hydrogen peroxide-air mixture, hydrogen peroxide will condesne out in liquid phase. Subsequently hot, sterile air is blow through the system and vaporizes the hydrogen peroxide anew, so that the machine is dried. In this manner a complete killing of any bacteria present in the machine, which otherwise may have a detrimental effect on the keeping quality of the packed product, is assured.

The inert gas, which is used for filling the free volume of the packing containers, is supplied to the packing machine via a filter which prevents bacteria or other contaminants from accompanying the gas into the packing containers. The filter has to be sterilized before each production and ,moreover,it has to be exchanged at regular intervals. After every exchange a sterilization of the filter and the filter chamber is carried out so as to prevent any bacteria, which have accompanied the exchange of the filter, from reaching the inner, sterile space of the packing machine and the packing containers manufactured there. The sterilization of the filter takes place on known machines by means of saturated steam which during a certain period is passed through the filter, so that the filter and filter chamber as well as the discharge ducts are sterilized. Since the steam condenses in the filter chamber and on the filter, it is necessary, after the resterilization, to blow the parts clean with the help of air, which is conducted through the filter for an appropriate period. Steam and/or air may be passed into the machine, but have to be led out of the syste, which makes it necessary to use valves and ducts not only for the supply of steam and/or air but also for making possible the discharging of the same. At the same time use has to be made of valves to prevent any steam and/or air from penetrating into the duct system which connects the filter to the packing machine, and all this gives rise to a complicated system of ducts and valves which is very susceptible to faults. The process of sterilization of the filter too becomes correspondingly complicated, since it comprises repeated opening and closing of a great number of valves in a certain sequence which has to be accurately followed,if the sterility in the duct system as well as in the packing machine is not to be lost, with attendant, timeconsuming resterilization as a consequence.

It is generally desirable, therefore, to find a method for the sterilization of filters which is less complicated and consequently more reliable than the methods known earlier.

OBJECT AND SUMMARY OF THE INVENTION

It is an object of the present invention to provide a method for the sterilization of a filter which is simple to carry out and which leads to a more reliable and better result than the methods known hitherto.

It is a further object of the present invention to provide a method for the sterilization of a filter, this method being rapid and not subject to the disadvantages of methods earlier.

It is a further object of the present invention to provide a method for the sterilization of a filter, this method being capable of simple integration into the sterilization procedure, which is normally carried out only for those parts of the packing machine which are in contact with the packing material or the inside of the packing containers.

These and other objects have been achieved in accordance with the invention in that a filter in a gas supply duct to a packing machine has been given the characteristic that the gas supply to the one side of the filter is interrupted and a chamber on the opposite side of the filter is connected in series to a system known in itself for circulation of chemical sterilizing agent through the packing machine.

Preferred embodiments of the method in accordance with the invention have been given, moreover, the characteristics which are evident from the dependent claims relating to the inventive method.

It is generally desirable, moreover, to provide an arrangement for the sterilization of a filter, this arrangement being simpler than previously known, corresponding arrangements and lacking the disadvantages of the latter.

It is an object of the present invention, therefore, to provide an arrangement for the sterilization of a filter, this arrangement being of a simple design with a small number of ducts and valves.

It is a further object of the present invention to provide an arrangement for the sterilization of a filter, this arrangement having few movable parts and thus being capable of being manufactured and maintained at low cost.

It is a further object of the present invention to provide an arrangement for the sterilization of a filter, this arrangement being capable of being integrated into the existing presterilization arrangement.

These and other objects have been achieved in accordance with the invention in that an arrangement for the sterilization of a filter in a duct for the supply of gas to a packing machine comprising a system for circulation of chemical sterilizing agent has been given the characteristic that one side of the filter can be connected to an external gas source, whereas the opposite side of the filter can be connected in series to the said circulation system for sterilizing agent. Preferred embodiments of the arrangement in accordance with the invention have been given, moreover, the characteristics which are evident from the dependent claims relating to the inventive apparatus.

Through the method and the arrangement in accordance with the invention it is made possible to sterilize a filter in a supply duct to a packing machine simultaneously with the sterilization of the actual packing machine. Through connecting the side of the filter facing towards the packing machine to the system for circulation of sterilizing agents of the packing machine, the sterilization of the critical side of the filter can be done in connection with the machine sterilization and in principle without any special measures having to be taken. Since the pore size of the filter is very small, the filter will act during the sterilization procedure partly as a valve which does not allow any larger amounts of sterilizing agent to pass through to the opposite side of the filter. To ensure that sterilizing agent does not leak out into the supply duct for inert gas, a valve is provided which is closed in connection with the sterilization procedure, so that any flow in the duct is altogether excluded. This simplified sterilization procedure also means that the arrangement for the sterilization of the filter will be greatly simplified compared with previously known arrangements with the same object which will be described in greater detail in the following.

BRIEF DESCRIPTION OF THE DRAWINGS

A preferred embodiment of both the method and the arrangement in accordance with the invention will now be described in greater detail with special reference to the attached schematic drawing which only shows the details indispensable for an understanding of the invention.

FIG.1 is a schematic view showing the forming of packing containers from a packing material tube in a known packing machine with the supply ducts for gas and for contents clearly visualized.

FIG.2 is a schematic view of the actual filter and the arrangements necessary for the utilization and sterilization of the same.

Fig.3 is a schematic view of a previously known arrangement for making possible the utilization and sterilization of an inert gas filter in a known packing machine.

DETAILED DESCRIPTION OF A PREFERRED EMBODIMENT

The method and the arrangement in accordance with the invention may be used in a greater number of different types of packing machines which require to have a gas, e.g. inert gas, supplied to them in the course of the manufacture and filling of packing containers. Usually this means that the particular packing machine is of a sterile type, and such a packing machine is described in the Swedish patent application no. TP 586 mentioned earlier, to which reference is made. With regard to FIG. 1, which shows schematically a part of the operating principle of a packing machine of the aforementioned type, it is merely pointed out that the packing machine manufactures packing containers 1 by converting a packing material tube 2 which extends substantailly vertically through the machine and is moved downwards whilst at the same time contents are supplied via a filling pipe 3. With the help of sealing jaws, not shown, parts of the packing material tube 2 are pressed together at equal intervals and sealed transversely, so that individual packing containers 1 filled with the desired volume of contents 4 and a certain gas volume, known as head space 5, are obtained. The packing material, as well as the space in the packing machine which is in contact with the packing material or the contents, has been cleaned and sterilized before the start of production, e.g. by a chemical sterilizing agent, usually hydrogen peroxide, having been made to consense in the machine and be removed again by means of sterile hot air. The contents 4 supplied have been sterilized in advance, and the gas volume, which is to be enclosed in the packing containers together with the contents, must be constituted of a gas which on the one hand is free from bacteria and on the other hand is of such a type that it does not react with the particular contents, or affect their taste or appearance. For this purpose generally an inert gas, most frequently nitrogen gas ($N_2$), is used.

The contents 4, as mentioned before, are supplied to the packing material tube via a filling pipe 3 which is capable of being connected to a suitable source of contents. At the upper end of the filling pipe 3 a seal 6 is provided which surrounds the filling pipe and rests against the inside of the material tube. As a result a closed volume is created in the packing material tube 2 below the seal which is filled with inert gas via a gas supply pipe 7 extending through the seal 6 at a suitable rate in order to replace the gas which is consumed, that is to say the gas which in form of "head space" is enclosed in each packing container manufactured.

The packing machine described, or any other packing machine of the aseptic type known in itself, is connected, as mentioned previously, via the gas supply pipe 7 to an inert gas source, e.g. a pressure cylinder containing nitrogen gas. From the cylinder, not shown, nitrogen gas is conducted via a gas supply duct 8, a governor 16 for controlling the pressure and an inert gas valve 9 to a filter chamber 10 wherein is situated a substantially circular or cup-shaped filter 11. The filter 11 is arranged so in the filter chamber 10 that it surrounds the opening of the gas supply duct 8 into the filter chamber 10. The inside of the filter 11 thus can be connected via the inert gas valve 9 and the gas supply duct 8 to the gas source, whilst the opposite side of the filter can be connected via the filter chamber 10 in series on the one hand to the gas supply pipe 7, on th eother hand to the filling pipe 3. The gas supply 7 can be connected directly to the filter chamber, whilst the filling pipe 3 is connected via valves and branchings together with a headspace valve 12 and a pressure equalizing tank 13 to the lower part of the filter chamber 10. Thus the filter chamber 10 is capable of being connected via the gas supply pipe 7 and the filling pipe 3 in series to the inner, sterile space of the packing machine, so that it becomes possible in the sterilization of the sterile space of the packing machine with the help of chemical sterilizing agent to circulate the same not only through the said sterile space but also through the filter chamber 10, which will be explained in greater detail in the following.

The arrangement in accordance with the invention, framed by means of dash-dotted lines in FIG. 2, will be compared with an arrangement known earlier for the sterilization of a filter in a gas supply duct. This known arrangement is shown in FIG. 3 where, as in FIG. 2, the connection to the packing machine is indicated by means of a broken line. This known arangment, like the arrangement in accordance with the invention, comprises a gas supply duct 8' for inert gas, an inert gas valve 9', a pressure equalizing tank 13', a filter 11' (applied conventionally, that is to say with the inside in contact with the sterile space) and a head space valve 12'. Beside the parts mentioned, two further supply duct, namely a supply duct 14 for steam and a supply duct 15 for compressed air, also are required for the sterilization of the filter 11' before the same is connected via the head space valve 12' to the sterile space of the packing machine. Everyone of the supply ducts is provided with its own governor 16' and the steam supply duct moreover has a steam valve 17 whilst the compressed air supply duct has an air valve 18. The steam supply duct 14 joins onto the gas supply duct 8' after the pressure equalizing tank 13', and between the said tank and the junction a valve 19 is provided which is installed on the gas supply duct 8'. The compressed air supply duct 15 joins onto the gas supply duct 8' between the inert gas valve 9' and the pressure equalizing tank 13'.

When the three supply pipes 8', 14, 15 have converged to a single pipe, the filter 11' is reached, from which opens a condensate duct with a condensate valve 20. After the filter 11' the duct reaches the head space valve 12', but continues in an outlet pipe via an outlet valve 21.

The sterilization of the filter 11' together with the surrounding filter chamber takes place in the previously known arrangement known in FIG. 3 before the head space valve 12' is opened and connects the gas supply duct to the sterile space of the particular packing machine. More particularly, the sterilization of the filter 11' is done in that from an original position with all valves shown in closed position the steam valve 17 is opened first and thereafter the outlet valves 20,21, so that saturated steam can flow from a steam source (not shown) via the steam supply duct 14 through the filter 11' and further out through the outlet valves 20,21. When the steam has flow through the filter 11' for a sufficient time to ensure adequate sterilization, the outlet valve 21 and the steam valve 14 are closed. Then the air valve 18 is opened so that compressed air under appropriate pressure (controlled by means of the governor 16' in the air supply duct) can flow via the pressure equalizing tank 13' and the pressure equalizing valve 19 through the filter 11' and entrain any condensate producted by the steam from the filter and the filter chamber. The condensate flows out together with the compressed air on the one hand via the outlet valve 21, on the other hand via the condensate valve 20. When all condensate has been completely removed from the system, the condensate valve 20 and the air valve 18 are closed, whereupon the inert gas valve 9' can be opened, so that inert gas flows via the governor 16, the pressure equalizing tank 13' and the pressure equalizing valve 19 to the filter 11'. After a short instant the outlet valve 21 can be closed whereupon the headspace valve 12' is opened, so that inert gas can flow via the gas supply pipe 7 (FIG. 1) into the packing material tube 2 when the production of filled packing containers is started.

As will be evident from the above description of the known arrangement and method for sterilizing the filter, the arrangement is very complicated and the method comprises the opening and closing of a great number of valves in a predetermined, accurately planned sequence, since otherwise there is a considerable risk of bacteria reaching the sterile space of the packing machine.

The method in accordance with the invention achieves the same object in a very simple manner which, in addition, can be carried out at the same time as the sterilization of the inner, sterile space of the packing machine. This on the one hand simplifies the procedure, since only one sterilization operation has to be carried out, and on the other hand increases the safety, because owing to the simultaneous sterilization of the packing machine and the filter there is nevery any risk of bacteria from a non-sterile filter being able to get into the packing machine. Before each start of production and after each exchange of the filter 11 (which is done with closed inert gas valve 9 by opening of the filter chamber 10 and manual exchange of the filter) a sterilization of the filter and of the filter chamber is required, to ensure than any bacteria, which (during the filter exchange) have followed along into the chamber, are rendered harmless. The filter is a so-called absolute filter, that is to say its pore size is smaller than the size of the bacteria , and this means that only the side of the filter which is facing towards the sterile space of the packing machine has to be cleaned. When filters are of circular or cup-shaped type, bacteria usually will be present on the outside, since it is this surface which is touched and is exposed most during the manual installation of the filter. The sterilization operation is started in that chemical sterilizing agent, e.g. hydrogen peroxide gas mixed with air, is made to circulate within the machine, i.e. through the filling pipe 3 and the packing material tube 2, among others. Via the gas supply pipe 7 the sterilizing agent reaches the filter chamber 10 and the outside of the filter 11, to attain thereafter once again the filling pipe 3 via the pressure equalizing tank 13 and the head space valve 12 (which is open) by way of the duct system indicated. The sterilizing agent, driven by a pump (not shown), consequently circulates thorugh the sterile system of the packing machine as well as through the filter chamber 10. On the surfaces, which are at a temperature lower than the dew-point of the hydrogen peroxide-air mixture, the hydrogen peroxide will condense out in liquid phase, that is to say in the sterile space of the packing machine, in the pipes connected, in the filter chamber 10 and on the outside of the filter 11.

A limited quantity of sterilizing agent will also pass through the filter 11. Any further passage is prevented, however, by the inert gas valve 9 which is closed during the sterilization process. The condensation of the sterilizing agent occurs largely on the outside surface of the filter 11 and assures, as in the corresponding condensation in the internal space of the packing machine in the method known earlier, any killing of bacteria. necessary. When the circulation of sterilizng agent is interrupted, the remainders are removed with the help of hot, sterile air which, like the sterilizing agent, is made to circulate through the inner space of the packing machine as well as the particular ducts and filter chamber until the hydrogen peroxide has been vaporized again and has been removed from the system. When the circulation has been discontinued the head space valve 12 is closed and the inert gas valve 9 is opened, so that inert gas can be conducted via the gas supply duct 8, the filter 11 and the gas supply duct 7 into the interior of the packing material tube now sterilized, and fill the head space in each individual packing container produced.

Since the filter type used is generally of the so-called absolute type; that is to say has a pore size which is smaller than the bacteria occurring (maximum pore size generally 0.2 μm), bacteria cannot pass with the air flow or grow through the filter. It is completely sufficient, therefore, to sterilize only that side of the filter which is in contact with the sterile space of the machine.

The method for sterilization described is evidently considerably simpler than the previously known, similar method, and also provides considerably increased safety, since only two valves have to be handled during the operation. Through the joint circulation of sterilizing agent through the interior of the packing machine and the filter, an equivalent killing is assured, moreover, in all the spaces which during the production of packages are in communication with each other, thus preventing any danger of the packing material and the contents being reached by bacteria from an incompletely sterilized part of the system.

While this invention has been illustrated and described in accordance with a preferred embodiment, it is recognized that variations and changes may be made and equivalents employed therein without departing from the invention as set forth in the claims.

What is claimed is:

1. A method for sterilizing a filter in a gas supply system in a packing machine, comprising the steps of:
   - interrupting the flow of gas from a gas supply to a first surface of a gas filter which is exposed to the gas supply;
   - connecting a filter chamber, in which is exposed a second surface of the gas filter, in a closed loop with a chemical sterilization system of the packing machine; and
   - supplying a gaseous sterilizing agent to be sterilization system for carrying out a sterilization of the second surface of the gas filter, the gas filter having a sufficient resistance to flow for substantially preventing the sterilizing agent from reaching the gas supply; and
   - circulating the gaseous sterilization agent through the packing machine and the filter chamber.

2. A method in accordance with claim 1, wherein the gaseous sterilizing agent is hydrogen peroxide.

3. A method in accordance with claim 2, wherein the gaseous sterilizing agent is a mixture of hydrogen peroxide and air.

4. In a combination of a packing device, a gaseous chemical sterilization means operably connected to said packing device for sterilization thereof and a gas supply means having a filter therein connected to said packing device for supplying filtered inert gas thereto, wherein the improvement comprises: a gas supply duct connectable to a gas source and having an outlet; a filter chamber surrounding said outlet; said filter being positioned within said filter chamber and having a first surface exposed to said gas supply duct and a second surface exposed to the interior of said filter chamber; means for connecting said filter chamber in a closed loop with said chemical sterilization means of the packing machine; and valve means for isolating said gas supply duct and said gas supply system from exposure to gaseous chemical sterilant from the chemical sterilization means.

5. An arrangement in accordance with claim 4, wherein said filter is arranged in said filter chamber so that it surrounds said outlet of the gas supply duct in the filter chamber.

6. An arrangement in accordance with claim 4, wherein said filter is an absolute filter.

7. An arrangement in accordance with claim 4, wherein said filter has a maximum pore size of 0.2 μm.

8. An arrangment in accordance with claim 4, wherein the valve means includes a valve arranged between the filter and the gas source.

9. A method for sterilizing a filter in a gas supply system in a packing machine, comprising the steps of:
   - interrupting the flow of gas from a gas supply to a first surface of a gas filter which is exposed to the gas supply duct;
   - connecting a filter chamber, in which is exposed a second surface of the gas filter, in series with a chemical sterilization system of the packing machine;
   - supplying a gaseous sterilizing agent to the sterilization system, the gaseous sterilizing agent passing through the filter chamber and being exposed to the second surface of the gas filter, the filter having a sufficient resistance to flow for substantially preventing the gaseous sterilizing agent from passing therethrough; and
   - supplying air to the system, the air being of a temperature high enough to evaporate any condensed sterilizing agent remaining in the sterilizing system or on the filter.

10. A method in accordance with claim 9, wherein the gaseous sterilizing agent is hydrogen peroxide.

11. A method in accordance with claim 9, wherein the gaseous sterilizing agent is a mixture of hydrogen peroxide and air.

* * * * *